United States Patent [19]

Pudelko et al.

[11] 4,220,944

[45] Sep. 2, 1980

[54] RESISTANCE TRANSDUCER WITH A NON-LINEAR CHARACTERISTIC CURVE

[75] Inventors: Heinz Pudelko, Frankfurt am Main; Gerhard Kallweit, Frankfurt-Goldstein, both of Fed. Rep. of Germany

[73] Assignee: VDO Adolf Schindling AG, Frankfurt am Main, Fed. Rep. of Germany

[21] Appl. No.: 5,651

[22] Filed: Jan. 22, 1979

[30] Foreign Application Priority Data

Jan. 23, 1978 [DE] Fed. Rep. of Germany ..... 2802857

[51] Int. Cl.[2] ..... H01C 10/38

[52] U.S. Cl. ..... 338/176; 338/138; 338/165; 338/202; 338/307; 338/314

[58] Field of Search ..... 338/176, 160, 165, 180, 338/202, 217, 138–140, 307–309, 314, 320; 29/610

[56] References Cited

U.S. PATENT DOCUMENTS

| | | | |
|---|---|---|---|
| 1,889,379 | 11/1932 | Ruben | 338/142 X |
| 3,165,714 | 1/1965 | Dreyfus | 338/314 X |
| 3,239,789 | 3/1966 | Shaheen | 338/217 X |
| 3,353,134 | 11/1967 | Elarde | 338/314 X |

FOREIGN PATENT DOCUMENTS

| | | | |
|---|---|---|---|
| 43496 | 11/1972 | Japan | 338/142 |

*Primary Examiner*—C. L. Albritton
*Attorney, Agent, or Firm*—Martin A. Farber

[57] ABSTRACT

A resistance transducer with a non-linear characteristic curve, which transmitter has a resistance track with a variable cross-section on an insulating carrier and a slider engaging on the resistance track. On the resistance track on the insulating carrier of a thick layer system at least one additional layer is applied by the same technology made of a conducting resistor substance, and shaped such that it forms a rib which extends in a direction of movement of the wiper, the rib tapering outwardly perpendicularly thereto, and the wiper transversely engages the rib to form an approximately point-like contact surface.

7 Claims, 1 Drawing Figure

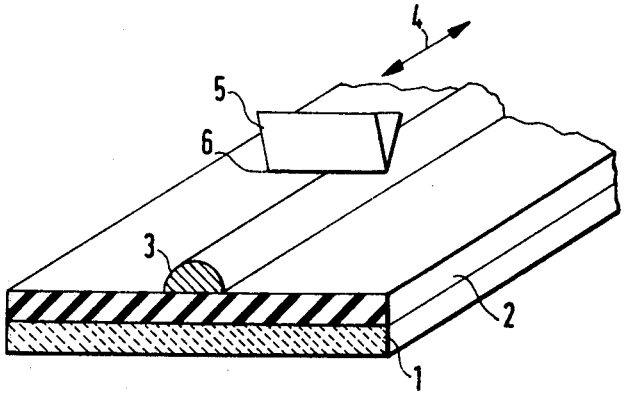
4
5
6
3
2
1

RESISTANCE TRANSDUCER WITH A NON-LINEAR CHARACTERISTIC CURVE

The invention relates to a resistance transducer or transmitter with a non-linear characteristic curve, which transmitter has a resistance track with a variable cross-section on an insulating carrier and a slider engaging on the resistance track.

Such a type of resistance transducer for example is used in level detectors or transmitters in which the wiper of the resistance transmitter stands in connection with a float via a lever. Generally such a resistance transmitter can even be used as a displacement transducer. Another possibility of use of the resistance transmitters is that they are an integral part of a pressure transducer. In this case a stroke or movement transducer also stands in connection with the wiper of the resistance transmitter via the intermediacy connection of transmission elements.

For this possibility of use of the resistance transmitters, frequently non-linear characteristic curves are desired, that is non-linear relationships between the resistance which is tapped-off on the resistor track and the position of the wiper on the resistor track. In the case of level measurements this can be desirable in order to achieve a linear indication even with an irregular container shape. On the other hand the task and object exists to change or convert a linear movement into a non-linear variable magnitude, for example, in order to represent certain level ranges spread apart or yet compressed.

For the formation of resistance transmitters with such a type of a non-linear characteristic curve it is known to use irregularly formed resistance carriers made of insulating material, on which there is wound a resistor wire. Additional non-linearities can be introduced by varying the spacing of the individual windings. With the production of such a resistance transmitter, however, care must be taken that by tapering or beveling the irregularly-shaped resistor carrier the resistor wire is not able to slide off, not even when the slider is shifted on the windings of the resistor wire. For this purpose the windings of the resistor wire which are wound on the resistor carrier must be partially lacquered or varnished, leaving the track of the slider or wiper free or exposed. This lacquering complicates the production further. An additional problem of conventional resistance transducers is that the resolution with the resistance variations which can be tapped off is relatively small, because the support surface of the wiper may not fall below a certain amount, so that under circumstances two to three windings are simultaneously covered or overlapped by the support surface. If definite or defined resistance variations are supposed to be achieved with small track changes, this becomes comparatively uncertain because of the end contact surface. A reduction of the wiper support, which theoretically makes possible a larger resolution, cannot be achieved with the conventionally wound resistance transmitters beyond a certain degree, so that even the resolution of the indication or reading, the latter which takes place by means of such a resistance transducer, is positively limited.

Further, potentiometers belong to the state of the art, which have a carbon track on a resistor carrier, whereby the cross-section of the carbon track can be variably shaped over the path of the wiper. Even in this case yet the problem of the relatively large contact surface between the carbon track and the wiper occurs since the wiper engages the carbon track practically over the entire width of the carbon track.

Finally there exists a further disadvantage of the known resistance transducer in that they still require and use a relatively great amount of space.

It is an object on which the present invention is based to create a resistor transmitter of the introductory-mentioned type with a non-linear characteristic curve, which while avoiding the disadvantages of the known resistance transducers, with a small construction size and a production with a cost which is most favorably possible, has the largest possible resolution capability.

It is another object of the present invention to aid the solution of the above-mentioned object for a resistor transducer of the introductory mentioned type characterized in the manner that on the resistance track (lower layer 2) on the insulating carrier of a thick layer system at least one additional layer (upper layer 3) is applied by the same technology made of a conducting resistor substance, and shaped such that it forms a rib which extends in a direction of movement (arrow 4) of the wiper (5), the rib tapering outwardly perpendicularly thereto, and the wiper transversely engages the rib to form an approximately point-like engagement or contact surface.

This resistance transducer has the important advantage that the resolution capability which is able to be achieved is very high on the basis of the approximately linear-like support surface of the wiper on the rib. Moreover the resistance transducer can be formed very compactly. Its production also is advantageous with respect to cost, because according to the silk screen process or printing methods used by the present invention, without great expense different rib cross-sections can be achieved along the wiper track and thus different non-linearities with high precision.

In a variant embodiment of the resistance transmitter in accordance with the present invention the rib (the upper layer 3) is applied by a plain, simple or single printing operation.

This formation of the resistance transmitter which requires only an additional printing of the rib is particularly economical.

In a modified embodiment of the resistance transmitter, the rib is applied on the resistor track by multiple printing with several layers.

With this formation thus the rib is not formed with only one sole or single layer, but rather with several layers which are formed on the resistor track spacially one over the over and timewise one after the other. In this manner one obtains a great freedom to move about in the design and shaping of the cross-section of the rib with non-problematic printing processes, i.e., with certainty.

The resistor transmitter is further advantageously formed in the manner that the upper layer (3) of the rib is upwardly rounded off.

In connection with the wiper which engages transversely on the uppermost position of the rib, an approximately linear-like support surface is achieved. Nevertheless wear and tear of the uppermost layer of the rib and of the slider is comparatively small as a result of the rounded shape of the rib.

In an advantageous manner the slider (5) is formed V-shape in cross-section.

With this in connection with the rib which tapers outwardly, the desired linear support surface is achieved, and on the other hand yet the slider obtains a sufficient rigidity or stiffness for a precise and reproducable adjustment or regulation of the resistance transmitter.

With the above and other objects and advantages in view, the present invention will become more clearly understood in connection with the detailed description of a preferred embodiment when considered with the accompanying drawing of which the only figure illustrates a perspective section partially broken away of the resistance transmitter in accordance with the invention.

Referring now to the drawing, an insulating carrier 1 of the resistance transducer or transmitter is provided. A lower layer 2 is applied on the resistance transducer in thick film technology. Moreover on the lower layer 2 there is applied an upper narrower layer 3 by thick layer processes, which upper layer is rounded off toward the top. Consequently the upper layer 3 forms a rib which tapers upwardly and extends in the direction of the arrow 4, namely in the direction of the movement path of a wiper or slider 5. The rib 3 stands in electrical conducting connection with the lower layer 2 of the resistance track, and forms a thick layer system with it as well as with the insulating carrier. The carrier particularly is made of ceramic.

The wiper 5 lies cross-wise with its elongated lower edge 6 on the upper side of the upper layer 3 which upper layer forms the rib. The cross-section of the wiper is approximately triangularly-shaped in the direction of the edge.

In the usual manner the wiper can be displaced along its movement path in the direction of the arrow 4 while contacting the upper layer 3. In every case the lower edge of the wiper forms an approximately point-like support surface with the upper layer 3 which forms the rib.

While there has been disclosed one embodiment of the invention, this embodiment is given by example only and not in a limiting sense.

We claim:

1. A resistance transducer with a non-linear characteristic curve having a resistance track with variable cross-section on an insulating carrier and a slider operatively engaging on the resistance track, comprising an insulating carrier, a resistance track of a thick layer system on said insulating carrier, at least one additional layer applied on said resistance track in the same technology made of a conducting resistance material formed such that the additional layer forms a rib which extends in the direction of movement of the slider, the rib tapering rounding off perpendicular thereto outwardly, and a slider formed V-shaped in cross-section, said slider and said rib tapering substantially in directions toward each other, said slider having an elongated edge at a narrowest portion of its V-shape, said edge being oriented relative to said rib forming an approximately point-like engagement surface transversely engaging said rib, said rib and said edge of said slider extend substantially perpendicularly to each other such that a point-like contact of said slider and said rib occur.

2. The resistance transducer according to claim 1, wherein said rib constitutes a single printed layer.

3. The resistance transducer according to claim 1, wherein said rib comprises multiply printed several layers on said resistance track.

4. The resistance transducer as set forth in claim 1, wherein the length of said elongated edge of said slider is substantially greater than the maximum width of said rib.

5. The resistance transducer as set forth in claim 1, wherein said V-shaped in cross-section is a cross-section substantially parallel to said rib, said slider has a wedge-shape having a non-V-shaped cross-section through a plane extending perpendicularly to said rib.

6. A method for forming a resistance transducer comprising applying a resistance layer on an insulating carrier in thick layer processing, applying a longitudinal rib made of a conducting resistance material on said resistance layer by a thick layer processing, so as to form a rib tapering rounding off outwardly, forming a slider with a linear edge oriented transversely to the longitudinal rib with approximately point-like engagement surface against said rib.

7. The method as set forth in claim 6, wherein said rib is applied by printing.

* * * * *